US012398557B2

(12) United States Patent
Wilson et al.

(10) Patent No.: US 12,398,557 B2
(45) **Date of Patent: *Aug. 26, 2025**

(54) MODULAR STRUCTURAL LOUVER AND METHODS OF USE

(71) Applicant: Span Construction & Engineering, Inc., Madera, CA (US)

(72) Inventors: Charles E. Wilson, Charlotte, NC (US); Alexander Mankin, Jacksonville Beach, FL (US); Ernest Brandi, Fresno, CA (US); David John Blink, Longmont, CO (US)

(73) Assignee: Span Construction & Engineering, Inc., Madera, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/766,570

(22) Filed: Jul. 8, 2024

(65) Prior Publication Data

US 2024/0368880 A1 Nov. 7, 2024

Related U.S. Application Data

(63) Continuation of application No. 18/144,386, filed on May 8, 2023, now Pat. No. 12,031,321, which is a (Continued)

(51) Int. Cl.
*E04B 1/70* (2006.01)
*E04B 1/98* (2006.01)

(52) U.S. Cl.
CPC ..... *E04B 1/7076* (2013.01); *E04B 1/98* (2013.01)

(58) Field of Classification Search
CPC ..... E04B 1/7076; E04B 1/98; E04F 10/10; E04F 13/007; E06B 7/08; F24F 13/08; (Continued)

(56) References Cited

U.S. PATENT DOCUMENTS 4,199,898 A 4/1980 Connor
4,253,492 A 3/1981 Sullivan
(Continued)

FOREIGN PATENT DOCUMENTS

EP 2753772 B1 12/2016
EP 2952078 B1 8/2019
(Continued)

OTHER PUBLICATIONS

YKK AP Inc, JP_Summary_translated,.https://worldwide.espacenet.com/patent/search/family/054841488/publication/JP2015224507A?q=pn%3DJP2015224507, JP2015224507A, Dec. 14, 2015.
(Continued)

*Primary Examiner* — Rodney Mintz
(74) *Attorney, Agent, or Firm* — Sierra IP Law, PC; Mark D. Miller

(57) ABSTRACT

Disclosed are methods and apparatus for providing pre-assembled modular structural louvered systems that include structural supports and louvers, and may also include dampers, actuators and wiring in pre-assembled modules that may be transported to a building site, tilted up into place, and installed. Embodiments of the present invention also provide methods and apparatus for providing pre-assembled modular structural louvered systems which include integrated vertical and horizontal structural supports, allowing for the elimination of some vertical and horizontal wall structures in a building by relying on the structural support provided in the modular louvered systems, thereby making more space available in the building for louvers and airflow.

13 Claims, 13 Drawing Sheets

Related U.S. Application Data continuation of application No. 17/556,826, filed on Dec. 20, 2021, now Pat. No. 11,643,809, which is a continuation of application No. 17/175,328, filed on Feb. 12, 2021, now Pat. No. 11,208,801.

(60) Provisional application No. 63/143,003, filed on Jan. 28, 2021.

(58) Field of Classification Search
CPC ..... F24F 13/082; F24F 13/18; F24F 2221/52; F24F 2221/44
See application file for complete search history.

(56) References Cited

U.S. PATENT DOCUMENTS

| | | | |
|---|---|---|---|
| 4,706,554 | A | 11/1987 | Baldino |
| 5,732,802 | A | 3/1998 | Tsukagoshi |
| 5,906,083 | A | 5/1999 | Olsen |
| 6,016,634 | A | 1/2000 | Sayer |
| 6,729,094 | B1 | 5/2004 | Spencer et al. |
| 8,001,730 | B2 | 8/2011 | Wallance |
| 8,065,846 | B2 | 11/2011 | McDonald et al. |
| 9,121,168 | B2 | 9/2015 | Levy et al. |
| 9,393,510 | B2 | 7/2016 | MacDonald |
| 9,422,715 | B1 | 8/2016 | Selzer |
| 9,713,289 | B2 | 7/2017 | Rasmussen et al. |
| 9,769,957 | B1 | 9/2017 | Towner et al. |
| 9,816,284 | B2 | 11/2017 | Konishi |
| 10,619,886 | B2 | 4/2020 | Cermak |
| 10,753,638 | B2 | 8/2020 | LeBlanc |
| 10,760,817 | B2 | 9/2020 | Gohring |
| 10,823,451 | B2 | 11/2020 | Gohring |
| 10,858,841 | B1 | 12/2020 | Rockhold |
| 10,988,926 | B2 | 4/2021 | Mitchell |
| 11,208,801 | B1 | 12/2021 | Wilson |
| 11,326,349 | B2 | 5/2022 | Jackson |
| 11,350,542 | B2 | 5/2022 | Roy |
| 11,643,809 | B2 | 5/2023 | Wilson et al. |
| 11,686,101 | B2 | 6/2023 | Liang |
| 12,031,321 | B2 * | 7/2024 | Wilson ..... E04B 1/7076 |
| 2009/0264063 | A1 | 10/2009 | Tinsley et al. |
| 2010/0099349 | A1 | 4/2010 | Gohring et al. |
| 2014/0213169 | A1 | 7/2014 | Rasmussen |
| 2015/0135661 | A1 | 5/2015 | MacDonald et al. |
| 2017/0009477 | A1 | 1/2017 | Konishi |
| 2017/0097171 | A1 | 4/2017 | Cermak et al. |
| 2017/0265326 | A1 | 9/2017 | Totani et al. |
| 2018/0058060 | A1 | 3/2018 | Anderson et al. |
| 2018/0163569 | A1 | 6/2018 | LeBlanc et al. |
| 2018/0347175 | A1 | 12/2018 | Anderson et al. |
| 2018/0347849 | A1 | 12/2018 | Gohring et al. |
| 2019/0037728 | A1 | 1/2019 | Roy |
| 2019/0323232 | A1 | 10/2019 | Mitchell |
| 2019/0345714 | A1 | 11/2019 | Sievers et al. |
| 2021/0003313 | A1 | 1/2021 | Moyer, Jr. |
| 2021/0172646 | A1 | 6/2021 | Patil et al. |
| 2021/0214948 | A1 | 7/2021 | Jackson |
| 2022/0235545 | A1 | 7/2022 | Wilson et al. |
| 2022/0235555 | A1 | 7/2022 | Liang |
| 2023/0279657 | A1 * | 9/2023 | Wilson ..... E04F 13/007 52/302.1 |
| 2024/0401841 | A1 * | 12/2024 | Manoji ..... F24F 13/084 |

FOREIGN PATENT DOCUMENTS

| | | | |
|---|---|---|---|
| JP | 2015224507 | A | 12/2015 |
| TW | 201410947 | A | 3/2014 |
| WO | 2014117166 | A2 | 7/2014 |

OTHER PUBLICATIONS

Liu, TW_Bibliography_translated,.https://worldwide.espacenet.com/patent/search/family/050820752/publication/TW201410947A?q=pn%3DTW201410947, TW201410947A, Mar. 16, 2014.
Moffitt, Eco90_Catalog_2020, EcoStream 90 Natural Intake Ventilation, Dec. 1, 2020, Online.
Span and Moffitt, Span_Moffitt_Presentation_Oct. 19, 2020, Modular Louver Wall Discussion, Oct. 19, 2020, Online.
Moffitt, LV3035_Fixed_Louver_Catalog, LV3035 EcoStream Adjustable Drainable Wall Louver, Jul. 3, 2019, Online.
Moffitt, LVEAC_Combo_Louver_Catalog, LVEAC Combination Louver / Damper, Dec. 1, 2017, Online.
Moffitt, AMNS_Calvert_Images, Jul. 19, 2017, Calvert, Alabama.
Span and Moffitt, Span_Moffitt_Presentation_Nov. 13, 2020, Modular Louver Wall Discussion, Nov. 23, 2020, Online.

* cited by examiner

MODULAR STRUCTURAL LOUVER AND METHODS OF USE

BACKGROUND OF THE INVENTION

The present invention relates to exterior wall systems for buildings and structures, and more particularly to large modular structural louvers which are pre-assembled before installation to contain both structural support members for a building together with adjustable louvers, and related methods of manufacture and use.

Recent technological innovations have increased the popularity of cloud-based computer data storage systems. A typical data storage location may include several buildings, with each building housing hundreds of electronic data storage devices. These storage devices must usually be operational around the clock in order to provide continuous access to data. Typical data storage units are notorious for generating a great deal of heat. As a result, the buildings which house these systems must have highly efficient cooling/heat removal systems in order to keep the storage devices from overheating and becoming inoperable.

The design of buildings which house data storage devices generally include large arrays of adjustable louvers along one or more exterior walls of the building. These louvers allow for large volumes of air to be brought into and out of the building. A typical wall louver in such a building will allow a large volume of air to be brought into the building through one set of louvers, and exit from the building through a different set. The incoming air is first cooled, then it is circulated around the data storage devices where it absorbs heat from the devices which warms up the air, after which the warm air is sent back out of the building. In some buildings, one entire side of a building may be provided with air intake louvers and another (e.g. opposite) side of the building may be provided with air exhaust louvers. In other buildings, lower louvers may be used to intake cooler incoming air and upper louvers may be used to exhaust warmer outgoing air.

The construction of buildings with large louvered walls for housing data storage units presents many complexities. Such a building must first be structurally sound, which generally requires construction of horizontal and vertical walls with bracing for structural support, leaving large spaces for the louvers. After the framing of the building is constructed, the louvers are then installed on site. This involves not only attaching the louvers to the building framing, but also attaching a damper to each louver which is used to open and close the louver, attaching an electronic actuator to operate each damper, and installing wiring for the actuators, along with other related items as part of the overall installation. It is to be appreciated that the installation process must take place in a logical order. For example, wiring for the damper actuators may not be completed until the damper actuators are installed; the damper actuators may not be installed until after the dampers themselves are installed; the dampers may not be installed until the louvers they attach to are installed; the louvers may not be installed until the walls they attach to are constructed, and so on. Thus, interruption or delay of any of these constructions or installations will invariably delay subsequent tasks and installations. Mistakes or errors may also take place during such on-site constructions and installations.

The amount of area available for airflow through wall louvers may also be limited in current designs for buildings which house data storage units. In any building design, every structural wall element, particularly vertical and bracing structural supports, takes up space which becomes unavailable for airflow. For example, and without limitation, if a building design calls for 20-ft bays for the louvers, and 5-ft wide vertical supports between every such bay along a wall, then twenty-five percent (25%) of the length of the wall is not available for airflow. In such a building having, for example, a 350-foot linear side, a full 70 linear feet (20%) of that side is used for the vertical support walls, and is not available for air flow louvers. However, if it were possible to obtain some vertical support from the louvers, the same building could be re-designed to allow the number of vertical support walls to be reduced, for example, to allow for 30-foot bays between 5-foot vertical supports. If that were done, then only 50 linear feet (14.3%) of the side of the building would be unavailable for airflow, making another 20 feet available for louvers.

Similarly, designs of existing buildings which house data storage units also tend to include horizontal walls to which structures are attached that provide support for an exterior catwalk. For example, and without limitation, a louver wall may have a height of 26-feet, with a 3-foot horizontal wall along the top, and another 3-foot horizontal wall across a central area of the wall, so that catwalks may be provided along both of these horizontal walls. This leaves only 20 vertical feet for the louvers and air flow. However, if the central horizontal wall could be eliminated, while maintaining support for the catwalk, this would make an additional three vertical feet available for louvers and airflow, for a total of 23 vertical feet of airflow space.

Thus, reducing the number of vertical and/or horizontal walls needed for structural support would significantly increase the amount of airflow space available, leading to better and/or more efficient cooling, and/or potentially increasing the number of data storage units that the same sized building could reliably house.

It is therefore desirable to provide methods and apparatus that help avoid interruptions, delays and potential errors or mistakes associated with the on-site construction and installation of exterior louvered wall systems in buildings. It is also desirable to provide methods and apparatus that allow the amount of exterior building space taken up by structural support walls to be reduced, thereby making more space available for installation of louvers in order to increase airflow, improve cooling, and/or potentially increase data storage capacity in a building.

Embodiments of the present invention provide methods and apparatus which address these needs.

SUMMARY OF THE INVENTION

Embodiments of the present invention provide methods and apparatus for providing pre-assembled modular louvered wall systems that include structural supports and louvers, and may also include dampers, actuators and wiring in pre-assembled modules that may be transported to a building site, tilted up into place, and installed. Embodiments of the present invention also provide methods and apparatus for providing pre-assembled modular louvered wall systems which include integrated vertical and horizontal structural supports, allowing for the elimination of some vertical and horizontal wall structures in a building by relying on the structural supports provided in the modular louvered wall systems.

Embodiments of the invention include modular structural louver units that are pre-assembled away from a building construction site. This allows the completed units to be delivered to a building site when construction has reached a point where the building is ready for them to be installed, allowing them to be promptly installed after delivery without waiting for different trades to complete different parts of the installation at different times. Thus, instead of following the steps of installing the louvers, followed by the dampers, followed by the actuators, followed by the wiring-all of which could take hours, days or even weeks to complete-embodiments of the present invention already include all of these structures so that the pre-assembled units may be quickly and completely installed in one step. This allows for more rapid completion of buildings having exterior louvered walls when embodiments of the present invention are used.

Embodiments of the modular structural louver units of the invention include both vertical and horizontal secondary wall frame members which are strong enough to provide secondary support to a building into which the units are installed. This allows embodiments of the present invention to be incorporated into a building design and installed in the completed building to eliminate the need for some of the secondary wall support that would be needed in building designs without these embodiments. The vertical and horizontal secondary wall frame structures that are incorporated into the pre-assembled embodiments of the invention are made of strong and sturdy metal and are therefore capable of providing secondary structural support for a building.

By way of example and without limitation, an embodiment of a pre-assembled module of the present invention may include a pair of vertical metal structural support members at outside edges (left and right sides) of the module, with two or more horizontal metal structural support members extending between the vertical members forming a frame. The horizontal members may be at or near upper and lower edges of the frame. The sturdy construction of the frames of these embodiments makes it possible for the at least some of the vertical structural supports to be used in place of vertical wall structures of a building, thereby making the space previously occupied by the vertical wall structures available for installation of louvers for more airflow.

In some embodiments, one or more additional horizontal structural support members may be provided at other locations between the upper and lower edges of the frame. For example, and without limitation, a horizontal structural support member may be provided at an intermediary location between the upper and lower edges of the frame at a location where a catwalk will be provided. In these embodiments, such an intermediate member is available to provide horizontal anchoring locations for the catwalk supports. It is to be appreciated that embodiments that include one or more intermediate horizontal structural support members may be used in place of horizontal wall structures of a building, thereby making the space previously occupied by the horizontal wall structures available for installation of louvers for more airflow.

Embodiments of the invention having frames with vertical and horizontal metal support members may include a plurality of louvers that are attached to the frames. The louvers may be of any suitable size and number to efficiently cover the interior area of the frame. The louvers may be provided in different rows and columns. For example, and without limitation, an exemplary embodiment of the present invention may have a matrix of 18 louvers, arranged in six rows and three columns. In another embodiment, a matrix of 20 louvers may be arranged in five rows and four columns. In an embodiment with smaller louvers, then 32 of them may be arranged in eight rows and four columns; in an embodiment where larger louvers are used, then 15 of them may be arranged in five rows of three columns. It is to be appreciated that these are just some examples of the different arrangements of louvers that may be provided in different embodiments of the invention, and that any suitable number of rows and columns of louvers may be provided depending on the size of the louvers used and the size of the frame into which they are installed.

Some embodiments may be provided with only frames and louvers allowing for these pre-assembled embodiments to be installed as part of the structural support of a building at an early stage, and allowing for additional parts such as dampers, actuators, and wiring to be installed at a later time. In these embodiments, the louvers are sealed to the secondary members as part of the pre-assembly, so that a moisture barrier is already established before the units are shipped for delivery. Many of these embodiments are also provided with damper supports which make it easier to install the dampers themselves at a later time.

However, in many embodiments of the invention, the pre-assembled units also include dampers that are attached to the louvers, as well as electronic actuators that are engaged with the dampers so that the opening and closing operations of the louvers may be electronically controlled. Wiring may also be attached to the electronic actuators in these pre-assembled embodiments, and such wiring may be incorporated into the frame and run to a single point for easy hook up once on site. These embodiments are designed to be installed as completed and fully functional modular units, requiring only that the structural support members be attached to the building, and the wiring be connected to appropriate controls.

In different embodiments of the modular units of the present invention, the vertical structural support members may have a height ranging from approximately four feet (4') to approximately forty (40'), and the horizontal structural support members may have a width (length) ranging from approximately four feet (4') to approximately ten (10'). These may be fitted with louvers & dampers having a depth of between six inches (6") and twelve inches (12"). These may also be fitted with actuators having an additional depth of between six inches (6") and twelve inches (12"). This allows for a wide range of different configurations, with different numbers of vertical supports, horizontal supports, and louvers/dampers/actuators.

By way of example and without limitation, in an exemplary embodiment of a small modular structural louver of the present invention, the vertical structural support members may be four feet (4') tall, and the horizontal structural support members may be four feet (4') wide, providing sufficient space for a single louver & damper. In another exemplary embodiment of a larger modular structural louver of the present invention, the vertical structural support members may be forty feet (40') tall, and the horizontal structural support members may be ten feet (10') wide, providing sufficient space for a bank of 36 louvers & dampers, each one being approximately 40" square. In another more typical exemplary embodiment of a large modular structural louver of the present invention, the vertical structural support members may be twenty-five feet (25') tall, and the horizontal structural support members may be ten feet (10') wide, providing sufficient space for a bank of 15 louvers & dampers, each one being approximately 40" square.

In one example, and without limitation, a louver may be approximately six inches (6") deep, and each associated damper may be approximately eight inches (8") deep, and each actuator may extend out approximately eight inches (8") from the damper. In this example, when open the louver blades may extend out about eight inches (8"), and reduce by two to three inches (2-3") when closed.

It is to be appreciated that different numbers of louvers & actuators may be installed on a given modular structural frame (the frame comprising the vertical and horizontal structural supports), depending on the dimensions of the particular louvers & actuators used. Larger numbers of smaller louvers & actuators may be used on a given sized frame, but smaller numbers of larger louvers & actuators may be used on the same sized frame. It is to be appreciated that the dimensions of a particular modular structural frame may be determined by the size(s) of the bays or openings in the building where the frame is to be installed, and that once these dimensions are known, the dimensions of appropriate louvers & dampers may be selected to make optimal beneficial use of the space provided by the modular structural frame.

It is therefore an object of the present invention to increase the amount of space available for airflow on a side of a building by providing pre-assembled modular louvered wall systems that include secondary structural support members which allow the modular systems to be incorporated into the design of the building to minimize the number of airflow-blocking wall supports that might otherwise be needed.

It is also an object of the present invention to avoid delays, interruptions and potential errors, and improve safety at a construction site by providing pre-assembled modular louvered wall systems that include at least secondary structural support members and louvers in pre-assembled modules that may be transported to a building site, tilted up into place, and installed in simple steps.

It is also an object of the present invention to provide methods and apparatus for providing pre-assembled modular louvered wall systems which include integrated vertical and horizontal structural supports, allowing for the elimination of some vertical and horizontal wall structures in a building by relying on the structural supports provided in the modular louvered wall systems.

Additional objects of the invention will be apparent from the detailed descriptions and the claims herein.

DETAILED DESCRIPTION

Figure 1:
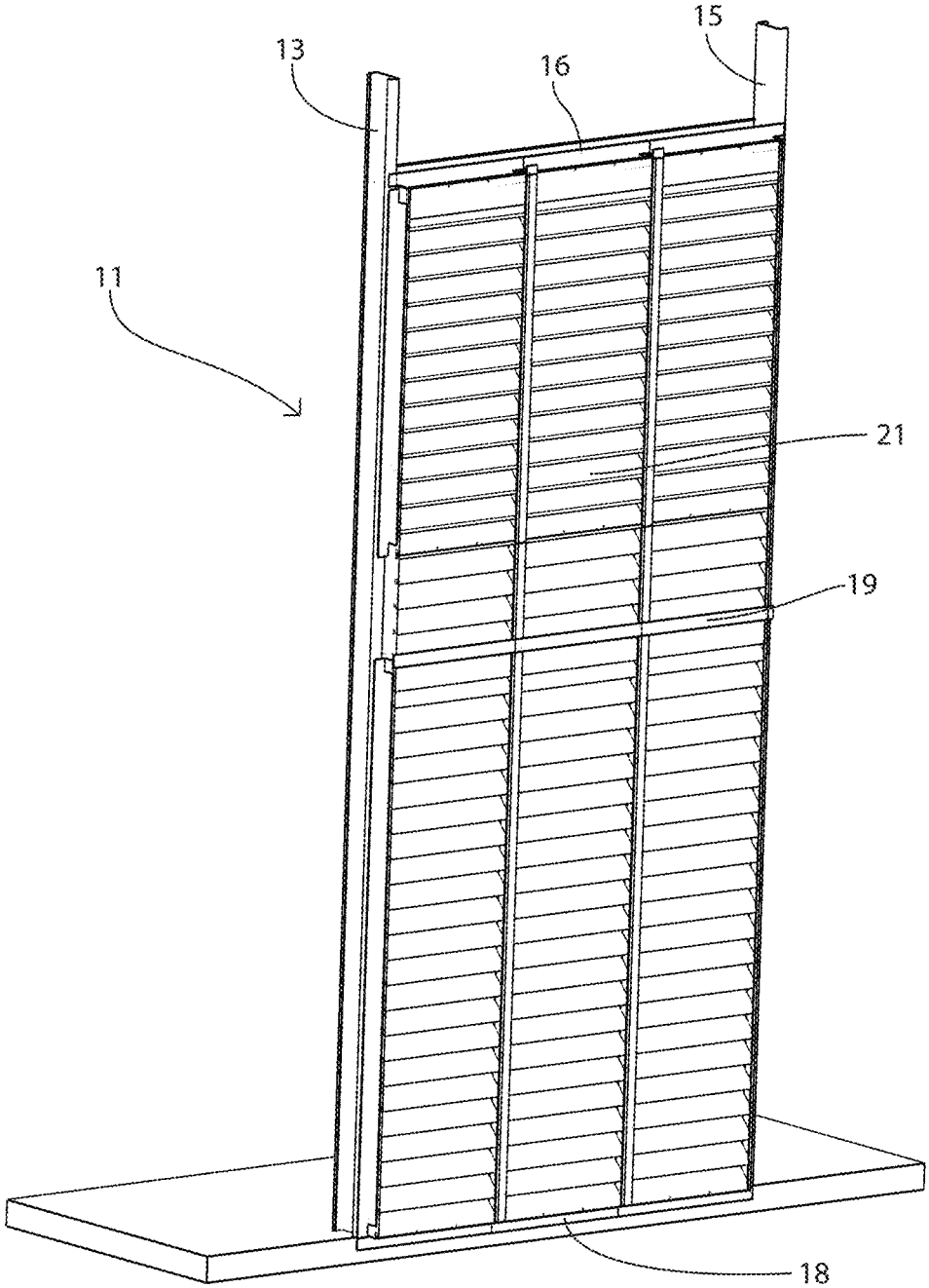
FIG. 1 is a front perspective view of an embodiment of the invention showing a pre-assembled modular unit prior to installation on a building.
Figure 2:
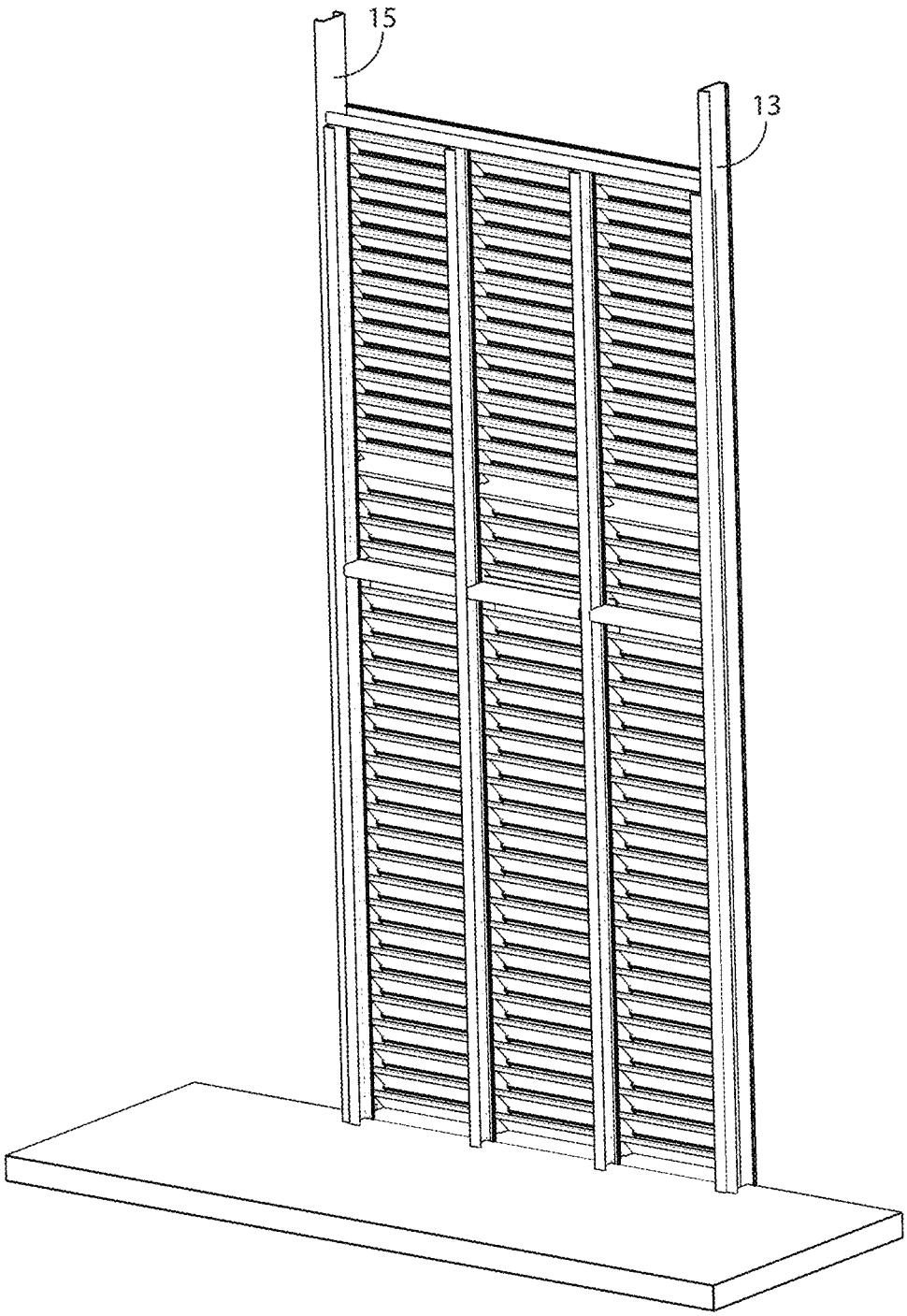
FIG. 2 is a rear perspective view of the embodiment of FIG. 1, with no dampers shown.
Figure 3:
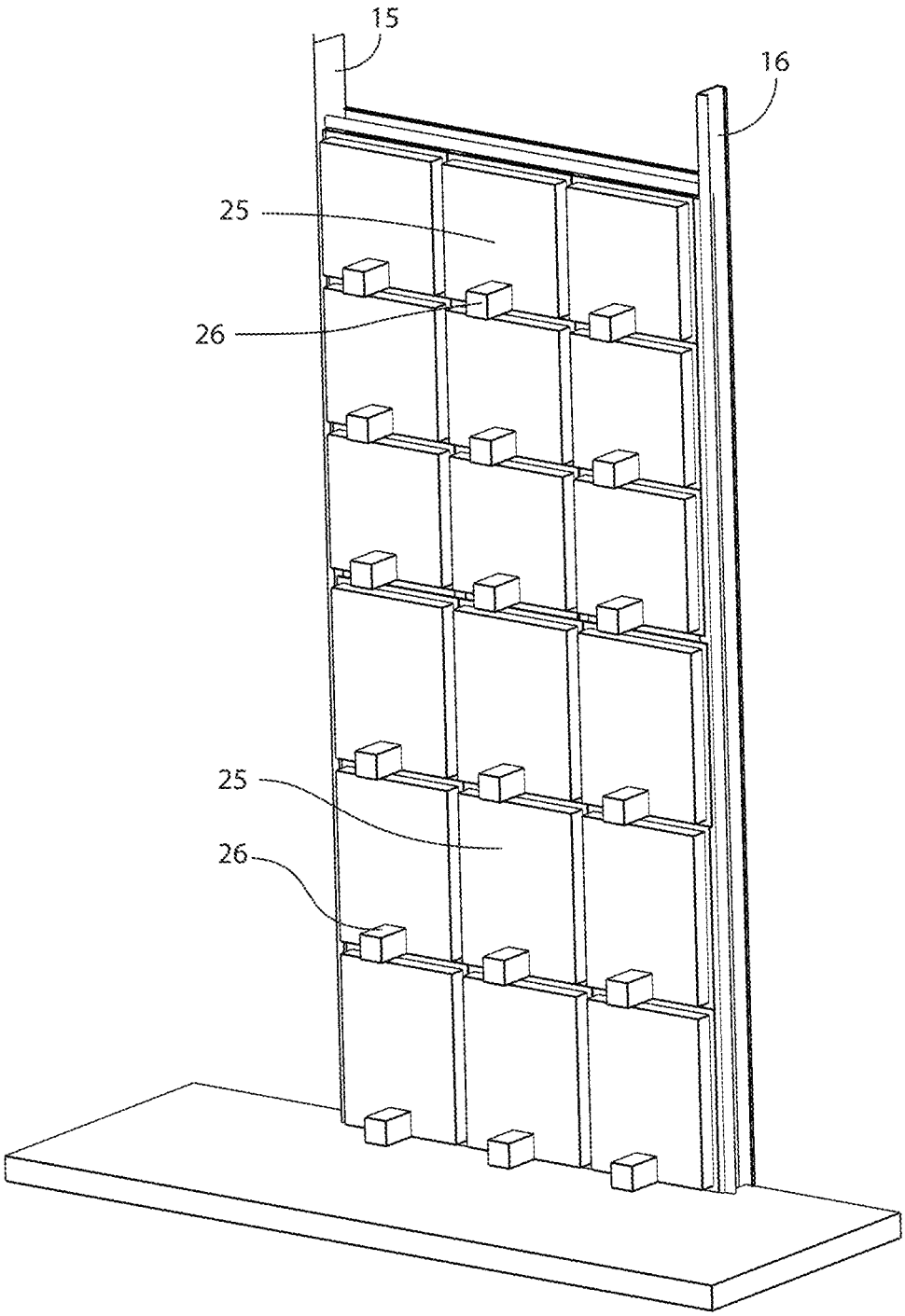
FIG. 3 is a rear perspective view of the embodiment of FIG. 1, with dampers.

Referring to the drawings wherein like reference characters designate like or corresponding parts throughout the several views, and referring particularly to the exemplary embodiment of FIGS. 1-3, it is seen that in this illustrated embodiment, a pre-assembled support frame 11 is provided having two vertical secondary structural support members 13 and 15, and two horizontal structural support members 16 and 18. These support members are made of iron, steel, aluminum or other sturdy metal. Between horizontal members 16 and 18, one or more additional horizontal members may be provided, such as member 19, depending on the height of the frame 11. The pre-assembled unit includes a plurality of louvers 21 at the front (FIG. 1). FIG. 2 shows the back of the unit before installation of the dampers and actuators, and FIG. 2 shows the back of the unit with dampers and actuators installed. It is to be appreciated that the view of FIG. 3 is not representative of actual dampers and actuators; details of an actual damper 25 and actuator 26 is shown in FIG. 13.

Figure 13:
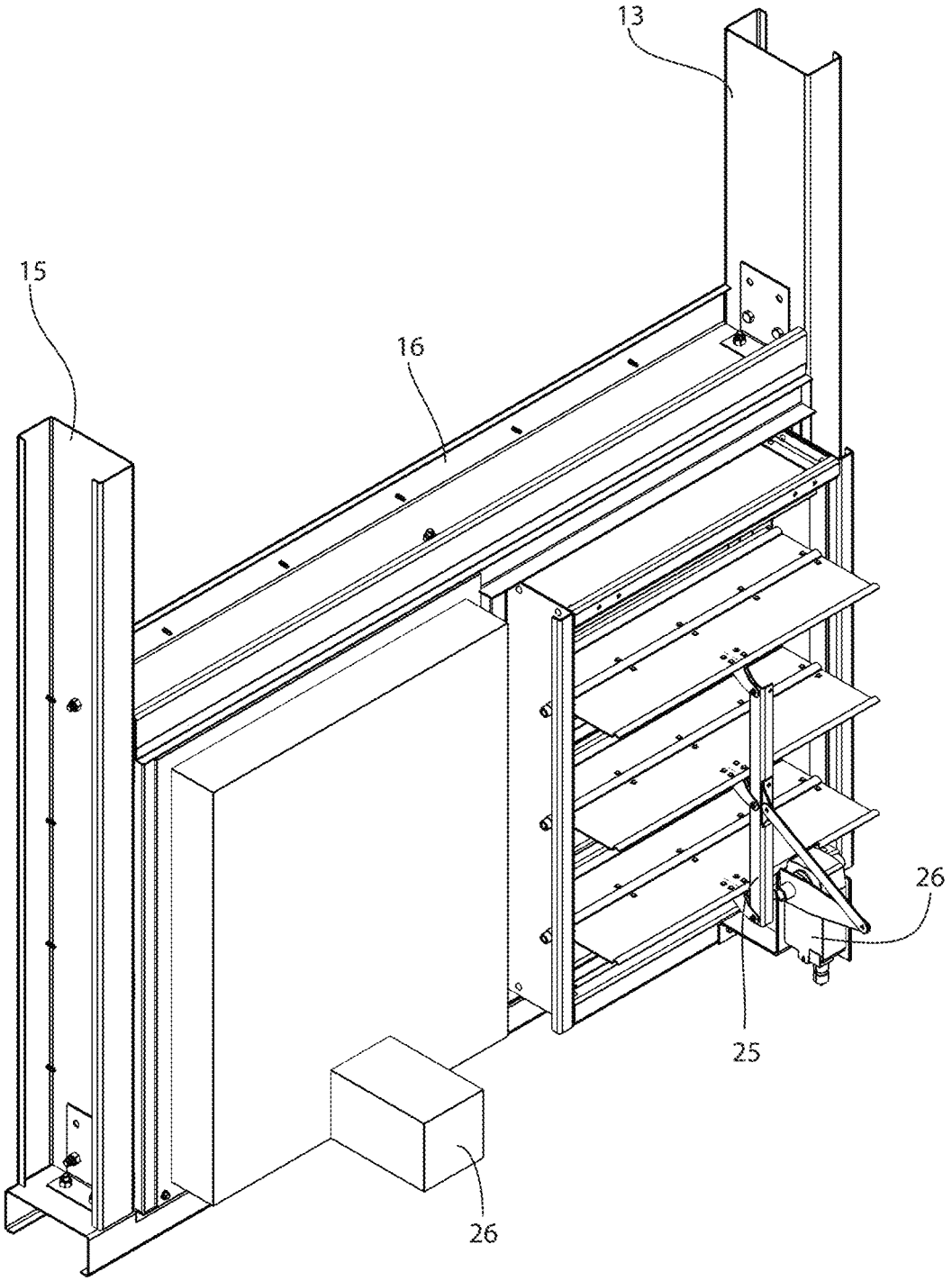
FIG. 13 is a close-up view of an embodiment of the present invention showing detail of a pre-assembled frame with louver, damper and actuator.

Referring to the illustrated example of FIG. 13, it is seen that the exemplary damper 25 is a vertical column that is attached to each of the pivotally mounted blades of the louver, such that moving the damper up and down opens or closes the louvers. This movement may be accomplished using a mechanical or electronic actuator 26.

Figure 4:
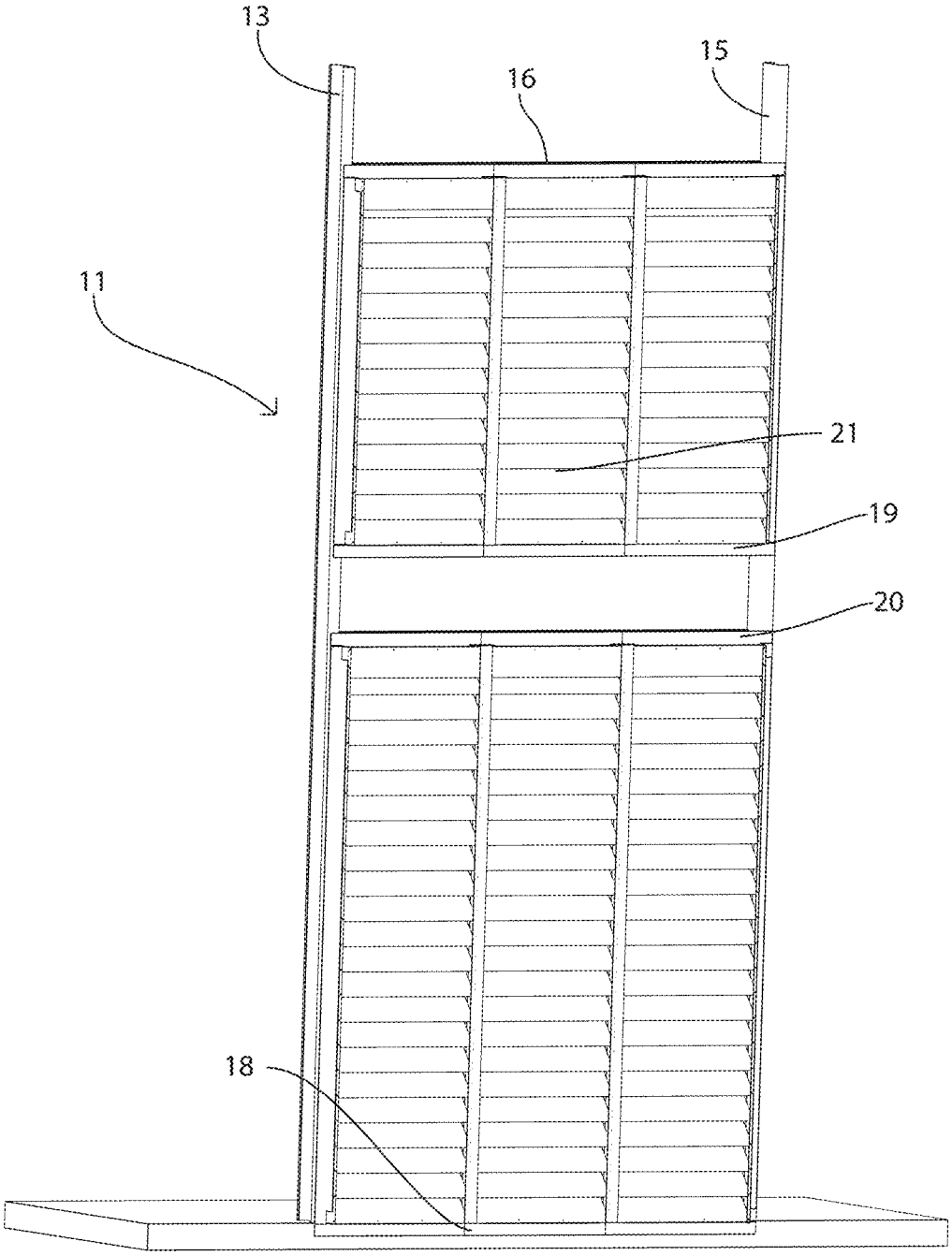
FIG. 4 is a front perspective view of another embodiment of the invention showing a pre-assembled modular unit prior to installation on a building.
Figure 5:
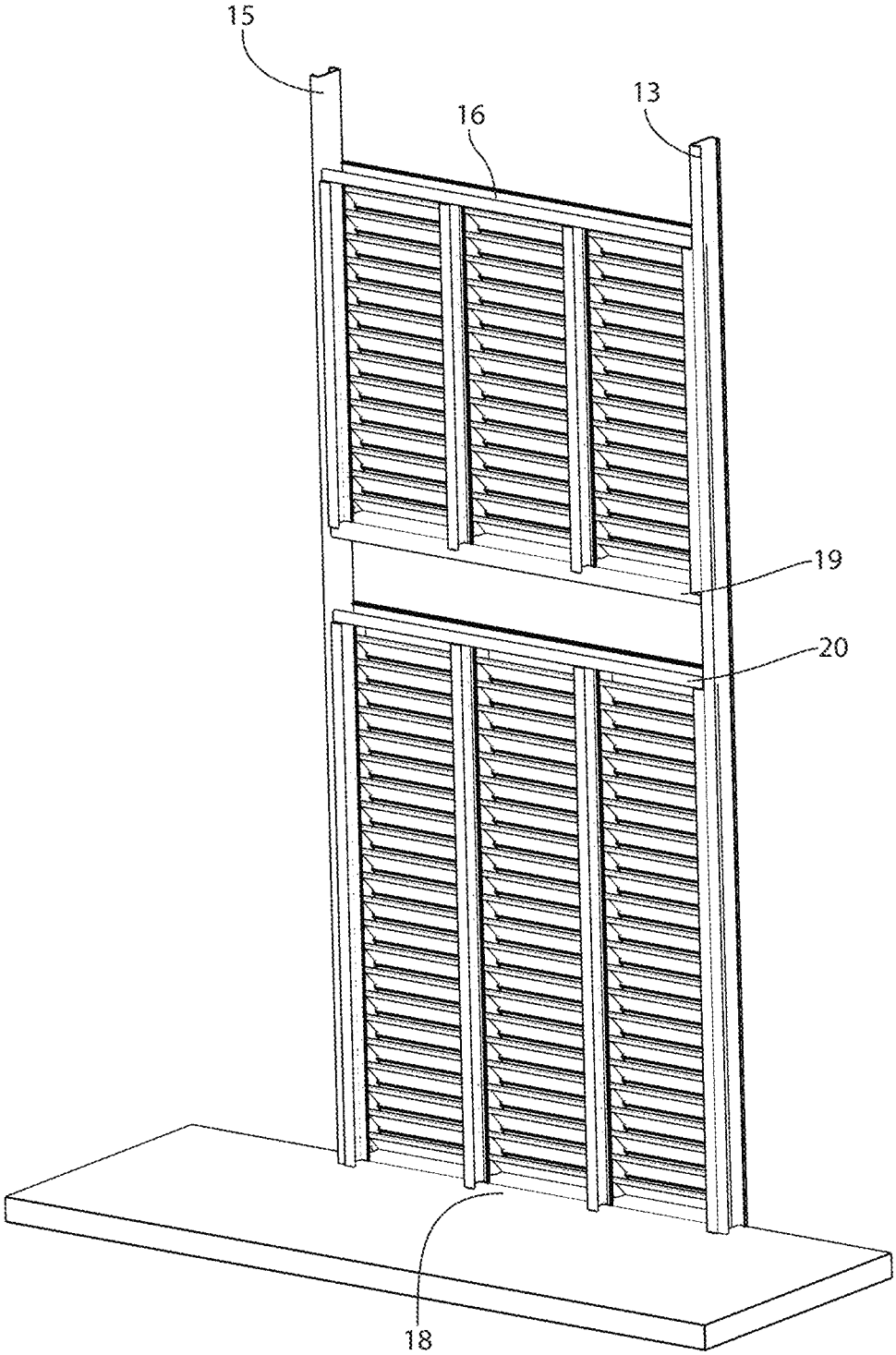
FIG. 5 is a rear perspective view of the embodiment of FIG. 4, with no dampers shown.
Figure 6:
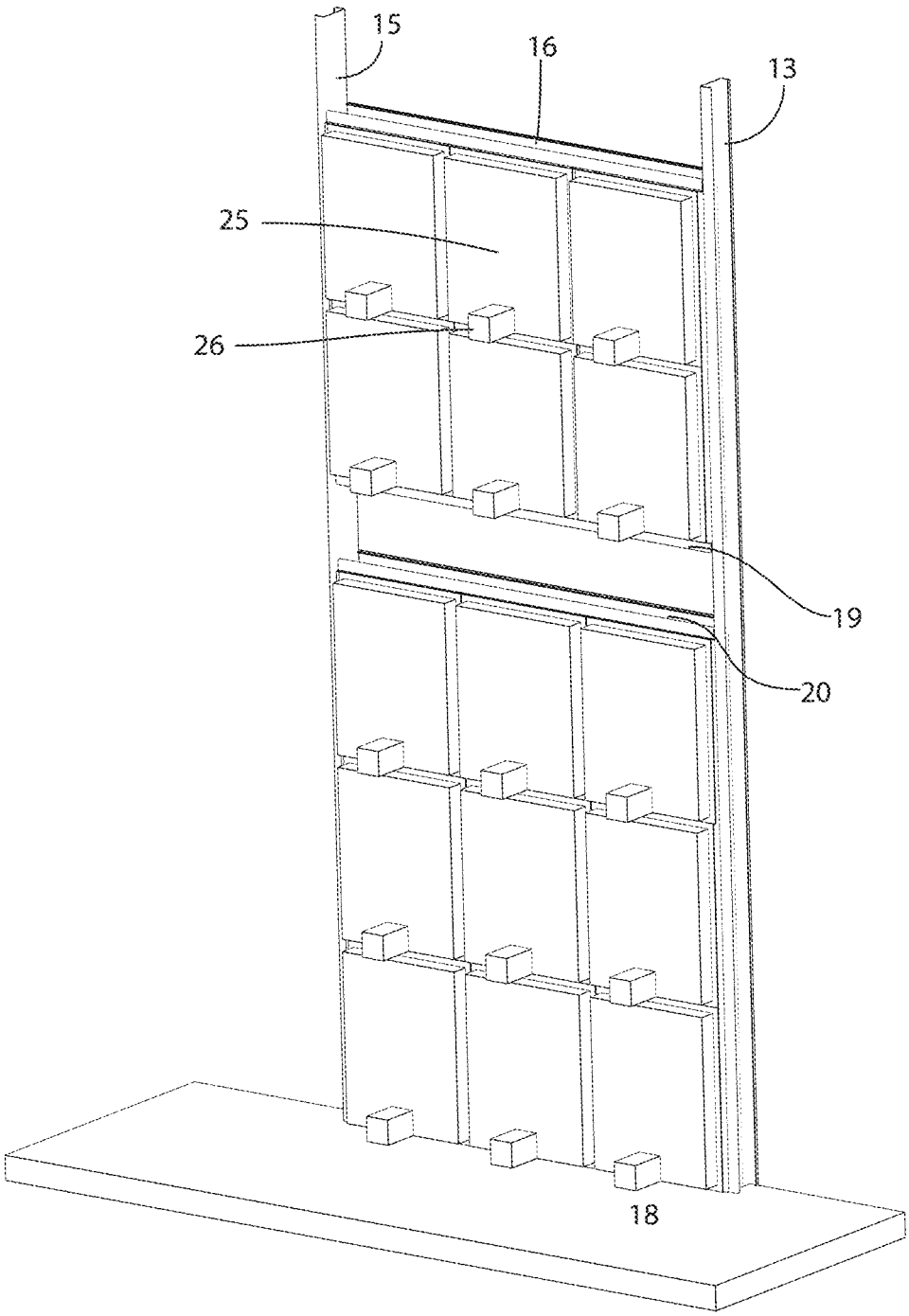
FIG. 6 is a rear perspective view of the embodiment of FIG. 4, with dampers.

The illustrated exemplary embodiment of FIGS. 4-6 shows two vertical secondary structural support members 13 and 15, two horizontal structural support members 16 and 18 at the top and bottom, and additional horizontal structural support members 19, 20 at locations between 16 and 18. In this embodiment, members 19 and 20 are near each other at the center of the unit 11, leaving a gap which may be needed for some structure of the building.

Figure 7:
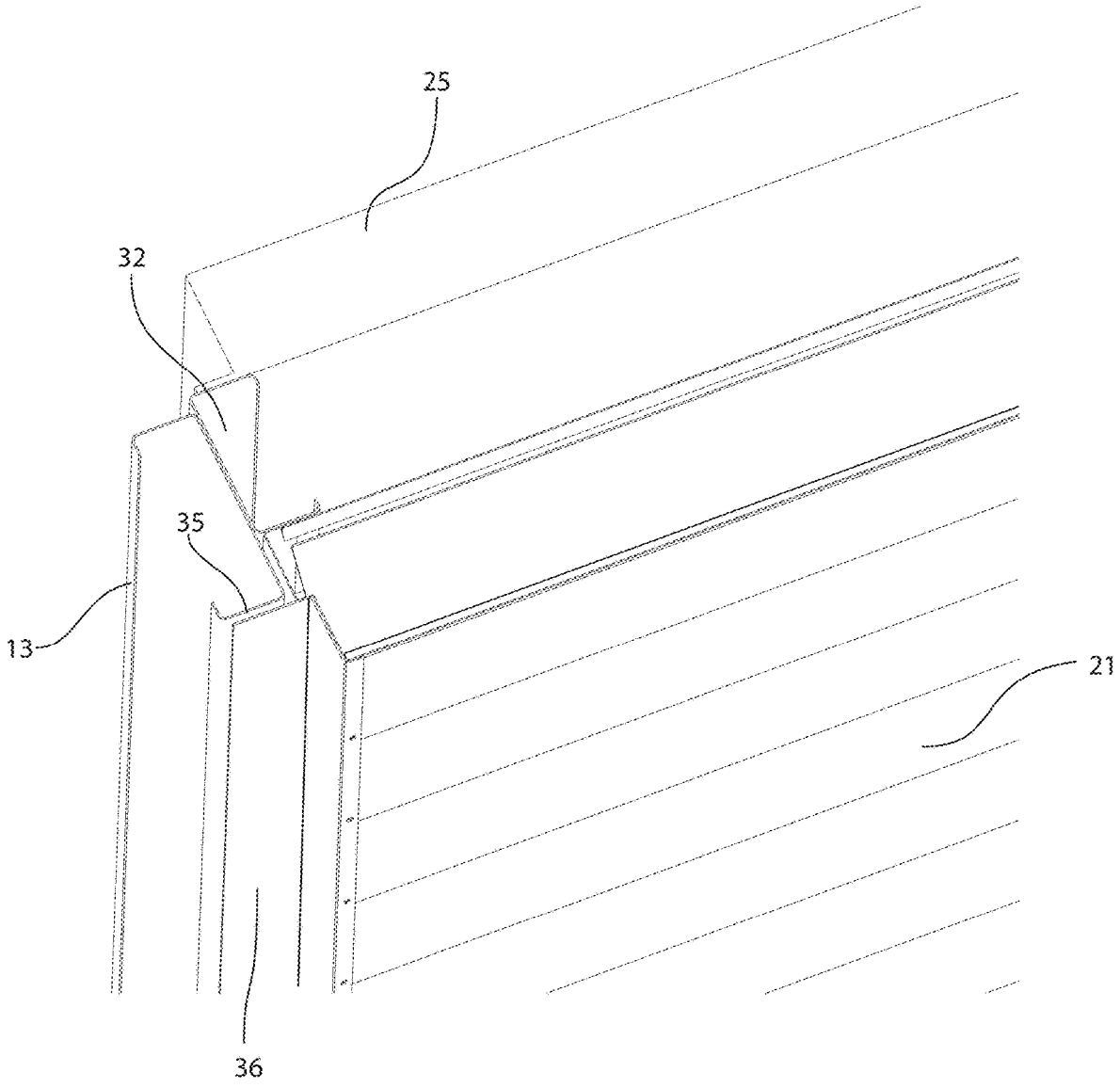
FIG. 7 is a close-up perspective view of an embodiment of the invention prior to installation on a wall.
Figure 8:
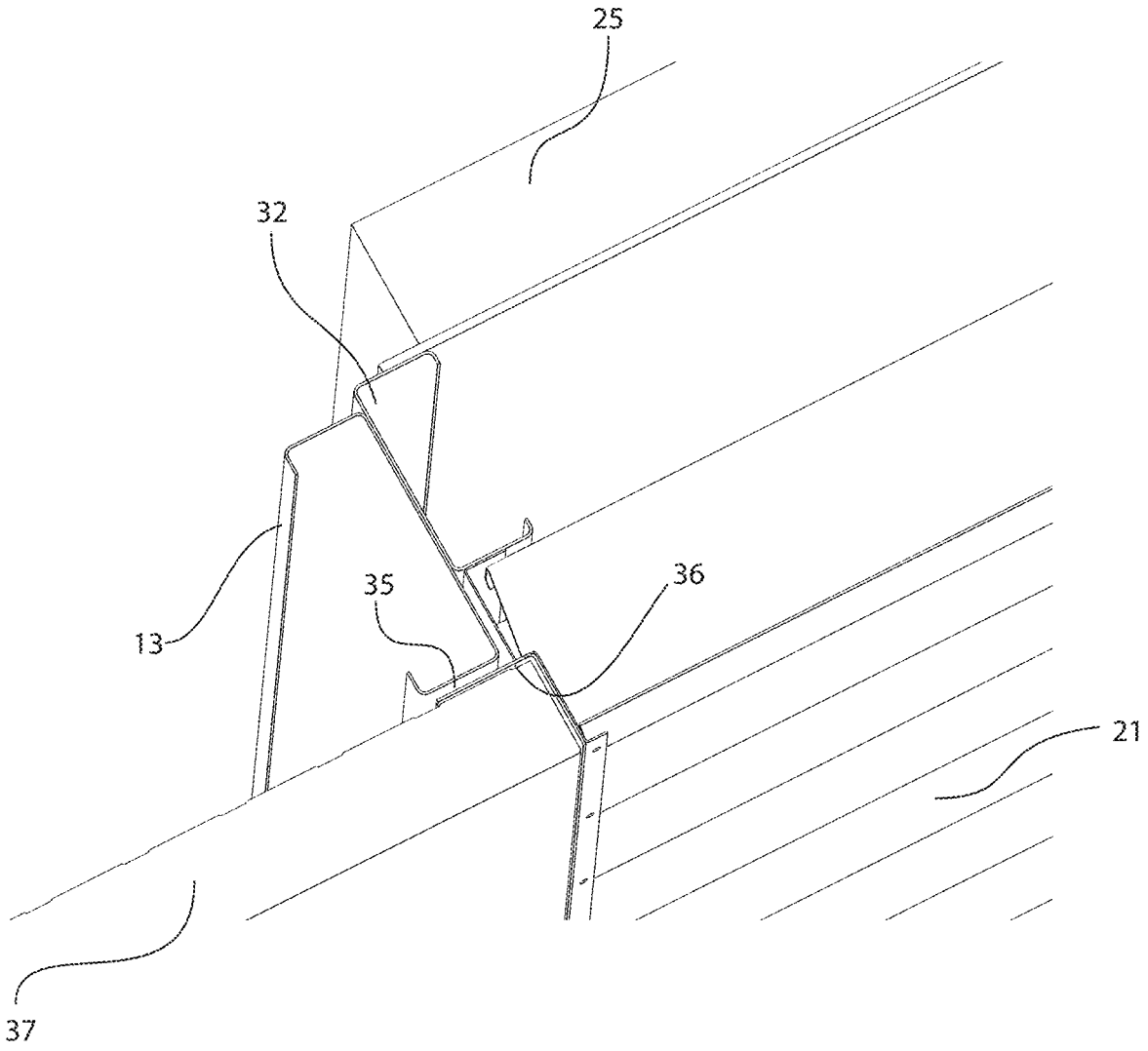
FIG. 8 is a close-up perspective view of the embodiment of FIG. 5 after installation on a wall.
Figure 9:
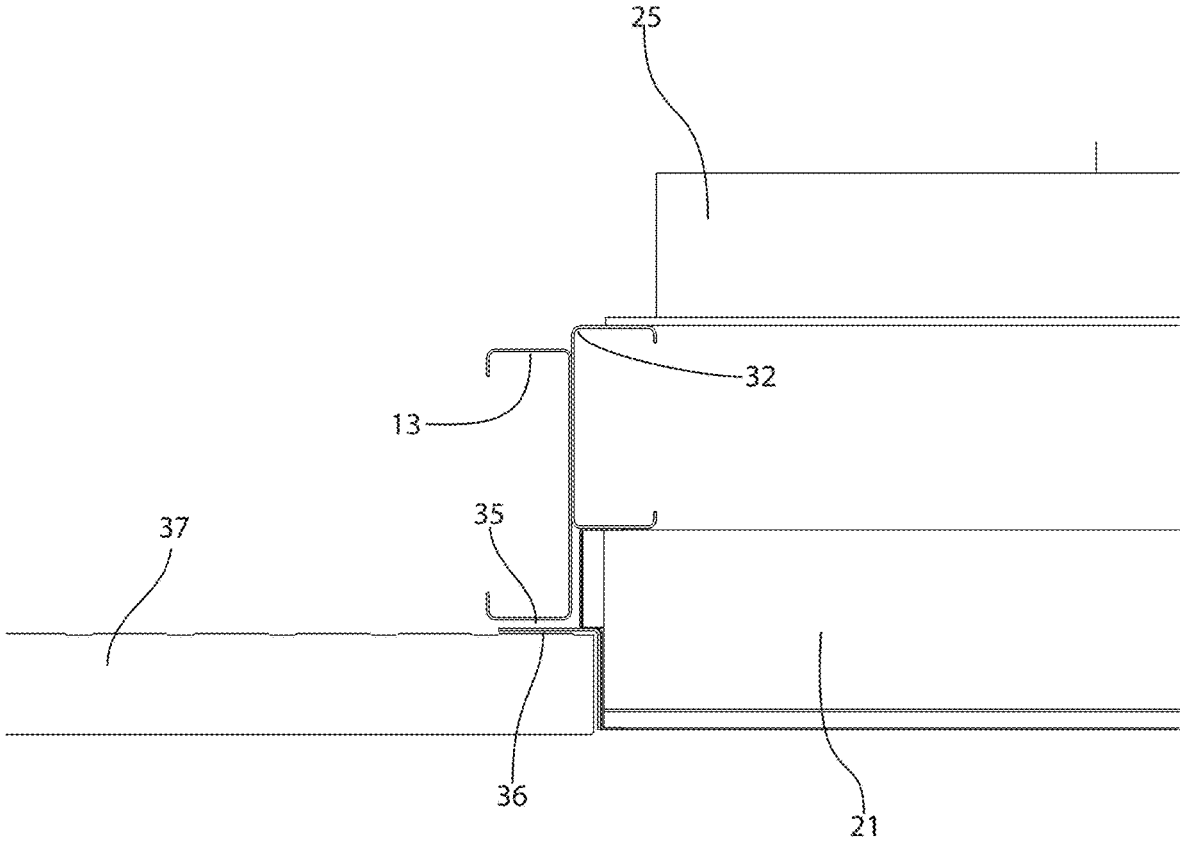
FIG. 9 is a top plan view of an embodiment of the invention.

The illustrated exemplary embodiment of FIG. 7 shows a close-up perspective view of an upper corner of a pre-assembled unit of the present invention. FIG. 8 shows the unit installed in a building, and FIG. 9 shows a top view of the installed version of FIG. 8. A vertical secondary support member 13 is shown attached to a louver 21. In this embodiment, the louver has a side flange 36 so that the outside face may be flush with the wall panel 37, as shown in FIG. 8. The louver flange 36 is sealed to the secondary member 13 at 35 before shipment. This seal provides a barrier against moisture and the like. A damper support member 32 may also be provided, and is attached to vertical member 13. One or more dampers 25 may also be installed and attached to support member 32. One or more actuators 26 (not shown) may also be installed and attached to each damper. Wiring may also be installed leading from the actuators to a common location for easy hook-up once the pre-assembled unit is delivered to the building site for installation.

Figure 10:
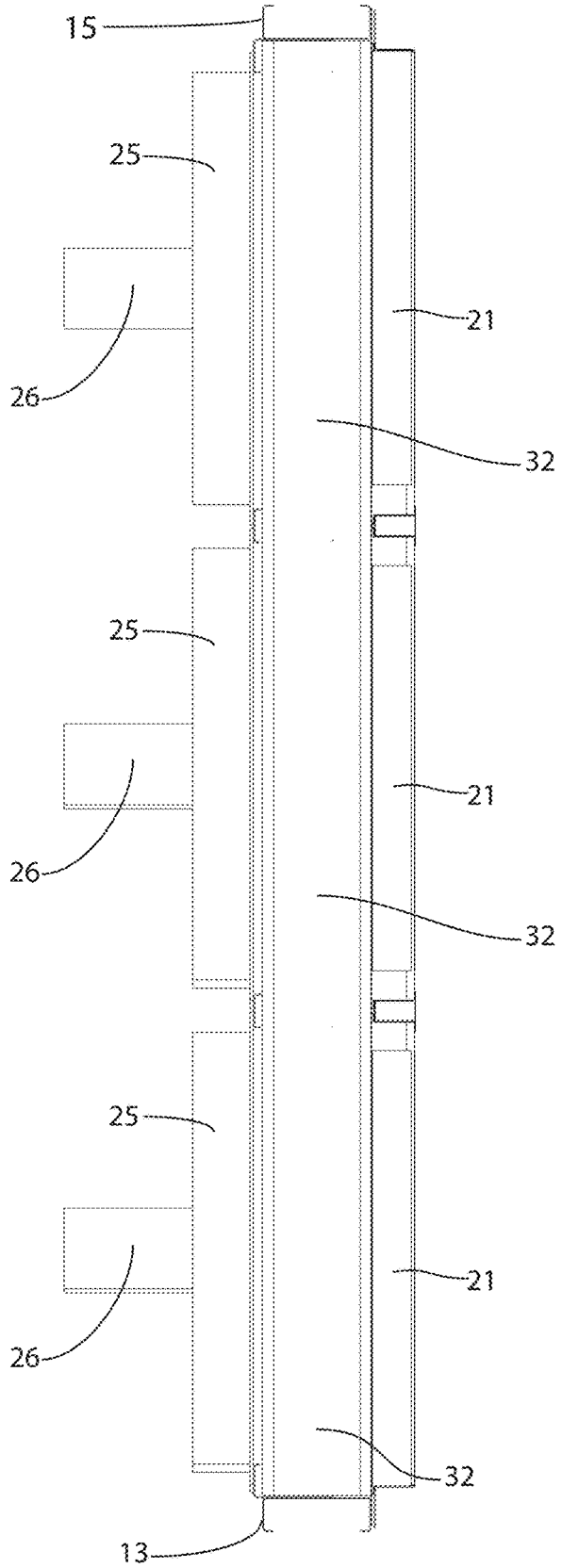
FIG. 10 is a top plan view of an embodiment of the invention installed in a building.

FIG. 10 is a top view illustration of an embodiment of the invention installed in a wall of a building. In this embodiment, three louvers 21 are provided adjacent to each other between vertical supports 13 and 15. The vertical supports are attached to the walls 37 of the building. The positions of the damper supports 32, dampers 25, and actuators 26 are all shown.

Figure 11:
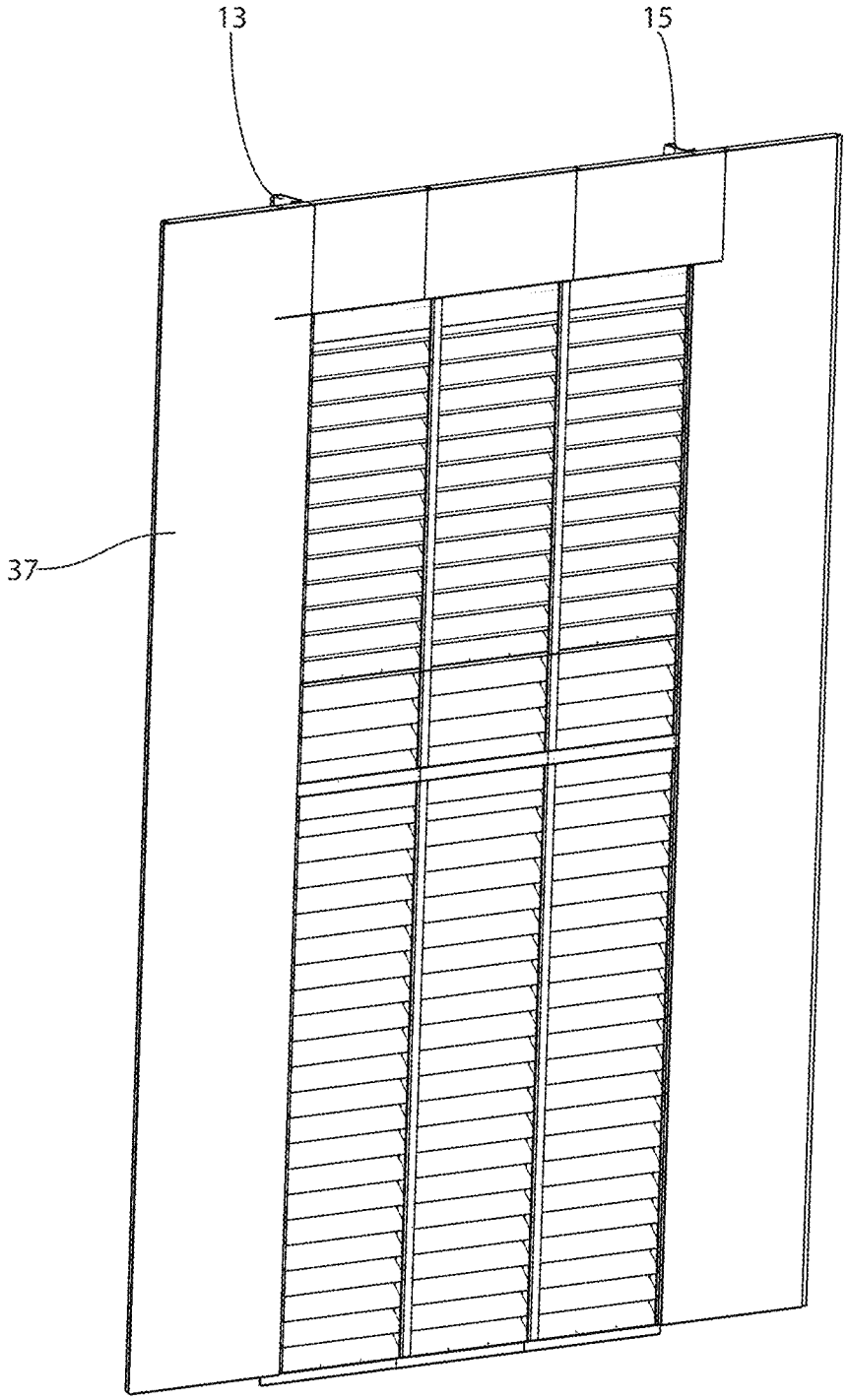
FIG. 11 is a front perspective view of an embodiment of the invention installed in a building.
Figure 12:
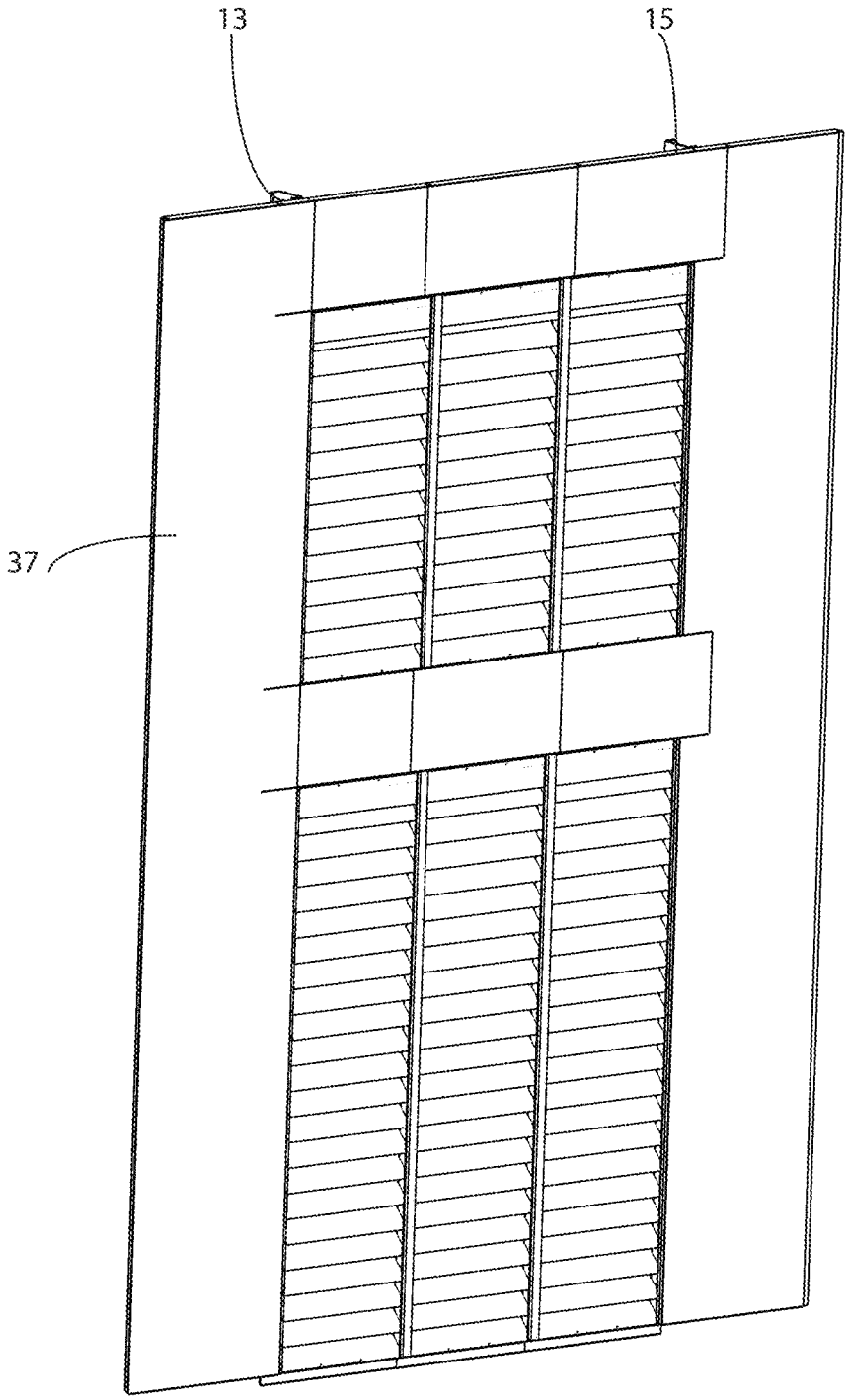
FIG. 12 is a front perspective view of another embodiment of the invention installed in a building.

FIGS. 11 and 12 illustrate two different embodiments of the invention installed in a building wall.

It is to be understood that variations and modifications of the present invention May be made without departing from the scope thereof. In particular, and without limitation, each of the various features and/or aspects of each embodiment disclosed herein may be used with other features and/or aspects of other embodiment disclosed herein in different combinations. Other combinations of features of the various embodiments disclosed herein are also included within the scope of the invention. It is also to be understood that the present invention is not to be limited by the specific embodiments disclosed herein, but only in accordance with the appended claims when read in light of the foregoing specification.

What is claimed is:

1. A pre-assembled modular structural louver system comprising:

a frame comprised of at least two vertical secondary structural support members configured to provide support to a building, and a plurality of horizontal structural support members wherein ends of said horizontal support members are attached to sides of said vertical support members;

a plurality of louvers attached to the frame wherein at least one vertical side flange is provided along an outside edge of said plurality of louvers, each such flange having a first surface that is sealed against one of said vertical support members and a second surface that is configured to fit flush against a wall panel upon installation;

a plurality of damper support members attached to said vertical support members; and a plurality of dampers, each of said dampers being attached to one of said plurality of damper support members;

wherein the modular structural louver system is configured to be completely assembled at a location other than a construction site of the building for subsequent transport to the construction site of the building for installation thereon.

2. The modular structural louver system of claim 1 further comprising a catwalk attached to an intermediate one of said horizontal support members.

3. The modular structural louver system of claim 1 further comprising a plurality of electronic actuators, at least one of said plurality of actuators being attached to one of said plurality of dampers.

4. The modular structural louver system of claim 3 further comprising a plurality of wires wherein one end of at least one of said plurality of wires is attached to at least one of said plurality of actuators.

5. A pre-assembled modular structural louver system comprising:

a frame comprised of at least two vertical secondary structural support members configured to provide support to a building, and a plurality of horizontal structural support members, wherein ends of said horizontal support members are attached to sides of said vertical support members;

a plurality of louvers attached to the frame wherein outside vertical flanges are provided on said louvers wherein one surface of each of said flanges is sealed against an edge of one of said vertical support members, and wherein an opposite surface of each of said flanges is configured to fit flush against a wall panel upon installation;

a plurality of damper support members attached to said vertical support members;

a plurality of dampers, each of said dampers being attached to one of said plurality of damper support members;

wherein the modular structural louver system is configured to be completely assembled at a location other than a construction site of the building for subsequent transport to the construction site of the building for installation thereon.

6. The modular structural louver system of claim 5 further comprising a catwalk attached to an intermediate one of said horizontal support members.

7. A method for constructing a building comprising the steps of:

a. at a location other than a construction site of the building, assembling at least one structural louver system comprising the steps of:

(i) erecting a frame comprised of at least two vertical secondary structural support members configured to provide support to a building, and a plurality of horizontal structural support members, wherein ends of said horizontal support members are attached to sides of said vertical support members;

(ii) attaching a plurality of louvers to the frame wherein vertical flanges are provided on outside edges of said louvers, each such vertical flange comprising an inside surface and an outside surface, wherein the outside surface is configured to fit flush against a wall panel upon installation;

(iii) sealing the inside surfaces of said vertical flanges against edges of said vertical secondary support members;

(iv) attaching a plurality of damper support members to said vertical support members;

(v) attaching a plurality of dampers to said plurality of damper support members;

b. transporting said at least one structural louver system in an assembled state to the construction site of the building; and c. installing said at least one structural louver system on the building.

8. The method of claim 7 comprising the additional step of attaching a catwalk to an intermediate one of said horizontal support members.

9. The method of claim 7 comprising the additional step of attaching a plurality of electronic actuators to said structural louver system wherein at least one of said plurality of actuators is attached to one of said plurality of dampers before said at least one structural louver system is transported to the construction site.

10. The method of claim 9 comprising the additional step of attaching a plurality of wires to said structural louver system wherein one end of at least one of said plurality of wires is attached to one of said plurality of actuators before said at least one structural louver system is transported to the construction site of the building.

11. A method for increasing an amount of air available for circulation in a louvered building comprising the steps of:

a. creating a design for the louvered building to include at least one modular structural louver system with vertical and horizontal structural supports in order to reduce space taken up by walls of said building such that additional space is available for louvers;

b. at a location other than a construction site of the building, assembling said at least one modular structural louver system comprising the steps of:

(i) erecting a frame comprised of at least two vertical secondary structural support members configured to provide support to a building, and a plurality of horizontal structural support members, wherein ends of said horizontal support members are attached to sides of said vertical support members;

(ii) attaching a plurality of louvers to the frame wherein vertical flanges are provided on outside edges of said louvers, each such vertical flange comprising an inside surface and an outside surface, wherein the outside surface is configured to fit flush against a wall panel upon installation;

(iii) sealing the inside surfaces of said vertical flanges against edges of said vertical secondary support members;

(iv) attaching a plurality of damper support members to said vertical support members;

(v) attaching a plurality of dampers to said plurality of damper support members;

c. transporting said at least one structural louver system in an assembled state to the construction site of the building; and d. installing said at least one structural louver system on the building.

12. The method of claim 11 comprising the additional step of attaching a catwalk to an intermediate one of said horizontal support members.

13. The method of claim 11 comprising the additional step of attaching a plurality of electronic actuators to said structural louver system wherein at least one of said plurality of actuators is attached to one of said plurality of dampers before said at least one structural louver system is transported to the construction site of the building.

* * * * *